US006551197B1

(12) United States Patent
Travo

(10) Patent No.: US 6,551,197 B1
(45) Date of Patent: Apr. 22, 2003

(54) GOLF PUTTING PRACTICE DEVICE

(76) Inventor: Chris Travo, 85 Viscount Dr., Townhouse 11C, Milford, CT (US) 06460-5781

( * ) Notice: Subject to any disclaimer, the term of this patent is extended or adjusted under 35 U.S.C. 154(b) by 0 days.

(21) Appl. No.: 10/053,122

(22) Filed: Jan. 23, 2002

(51) Int. Cl.[7] ..... A63B 53/06; A63B 53/16; A63B 69/36; A63B 57/00

(52) U.S. Cl. ..... 473/258; 473/278; 473/261

(58) Field of Search ..... 473/257–265, 473/206, 219, 226, 229, 231, 238

(56) References Cited

U.S. PATENT DOCUMENTS

| | | | | | |
|---|---|---|---|---|---|
| 1,567,530 | A | * | 12/1925 | Macnaughton et al. | 473/229 |
| 2,303,736 | A | * | 12/1942 | Hall | 473/258 |
| 2,723,858 | A | * | 11/1955 | Chizewski | 473/229 |
| 2,776,836 | A | * | 1/1957 | Zadina | 473/226 |
| 3,132,865 | A | * | 5/1964 | Parker | 248/166 |
| 3,269,733 | A | | 8/1966 | Taddie et al. | |
| 3,685,835 | A | * | 8/1972 | Fahy | 473/229 |
| 3,899,180 | A | | 8/1975 | Rodman | |
| 3,934,874 | A | | 1/1976 | Henderson | |
| 3,953,035 | A | * | 4/1976 | Beckisk | 473/229 |
| 4,129,301 | A | | 12/1978 | Kenney | |
| 4,133,535 | A | * | 1/1979 | Marsh | 473/229 |
| 4,235,440 | A | | 11/1980 | Hinckley | |
| 4,900,030 | A | * | 2/1990 | Houtz | 473/258 |
| 5,026,066 | A | * | 6/1991 | Kane | 473/227 |
| 5,074,565 | A | * | 12/1991 | Tucker | 473/229 |
| 5,131,657 | A | | 7/1992 | Hughes | |
| 5,169,150 | A | | 12/1992 | Tindale | |
| 5,332,211 | A | * | 7/1994 | Rife et al. | 273/DIG. 21 |
| 5,375,833 | A | | 12/1994 | Marier, Jr. | |
| 5,409,231 | A | | 4/1995 | Kueng et al. | |
| 5,435,547 | A | | 7/1995 | Lee | |
| 5,503,395 | A | | 4/1996 | Cook | |
| 5,586,945 | A | * | 12/1996 | Vonderhaar | 473/258 |
| 5,997,410 | A | * | 12/1999 | Nothdurft | 473/258 |
| 6,364,786 | B1 | * | 4/2002 | Khano | 473/226 |

* cited by examiner

*Primary Examiner*—Paul T. Sewell
*Assistant Examiner*—Alvin A. Hunter, Jr.
(74) *Attorney, Agent, or Firm*—Donald R. Schoonover

(57) ABSTRACT

A golf putting stroke is taught and practiced using a device that includes a frame element attached to the golf club. The frame element includes a golf club clamping unit that is slidably attached to a frame unit that is supported on the ground. The clamping unit includes elements that are rotatably attached to each other and the golf club is slidably held in the golf club clamping unit. Controlled movement of the golf club is effected by the practice device wherein the golf club can be moved in three rotational directions as well as in two linear directions.

4 Claims, 2 Drawing Sheets

GOLF PUTTING PRACTICE DEVICE

BACKGROUND OF THE INVENTION

1. Field of the Invention

The present invention relates to the general art of golf, and to the particular field of golf practice devices.

2. Discussion of the Related Art

Golf is an extremely popular game and is increasing in popularity all the time. With the increase in popularity of the game, there is a concomitant increase in the desire of individuals to become more proficient at the game. This desire is fueled by an increase in the number of tournaments and the like.

Accordingly, the art contains numerous examples of devices intended to be used to practice the golf swing.

The game of golf has several swings; however, one of the most intricate is the putting stroke. Since putting requires extreme accuracy and precision, any defect in the putting stroke is magnified and may manifest itself in the golfer's score.

Therefore, there is a need for a device which can be used to practice golf putting.

The art also contains numerous examples of devices that can be used to practice golf putting. However, none of these devices fully control movement of the club during the putting stroke and thus do not fully control the swing being practiced. Many of the presently available devices simply guide a golf putter head or shaft to and through contact with a golf ball. While somewhat effective, these devices are not fully effective because the golf putter is not fully controlled during the swing. This lack of control may result in a deficiency in the swing being practiced. For example, if the golf club is not fully controlled, a golfer could accidently jerk the club upwards during the swing and not affect the ultimate direction of the swinging movement of the club. While this may appear to be acceptable, it is not since the rhythm of a golf putting stroke may be nearly as important as the direction of its movement. The rhythm of a golf putting stroke may affect not only the direction of the putt, but the speed of that putt. Speed may affect the accuracy of a putt nearly as much as the direction of the putt.

Therefore, there is a need for a golf putting practice device that fully controls movement of the golf club during a practice session.

A golf putting stroke occurs in a plurality of planes. That is, the golf club may move up and down with respect to the ground, forward and back as well as rotationally in two directions, a yaw direction which is associated with the swinging movement of the stroke as well as a pitch direction that may be associated with golf putter head rotation and a roll direction that may also be associated with the swinging motion of the putting stroke. In order to fully practice and perfect such a complicated swing, control over the swing in all planes should be possible. Known devices do not exert control over a swing in all planes in which the swing occurs.

Therefore, there is a need for a golf putting practice device that can control all phases of a putting swing.

Still further, many golfers react to teaching devices differently from other golfers. That is, the type of control effected on the club during a practice session may alter the way a golfer reacts to the practice. One golfer may desire one type of club control; whereas, another golfer may not react well to that same type of control.

Therefore, there is a need for a golf putting practice device that can be modified to control a golf swing in a manner that is most effective to a particular golfer and which can be changed for different golfers.

PRINCIPAL OBJECTS OF THE INVENTION

It is a main object of the present invention to provide a device which can be used to practice golf putting.

It is another object of the present invention to provide a golf putting practice device that fully controls movement of the golf club during a practice session.

It is another object of the present invention to provide a golf putting practice device that can be modified to control a golf swing in a manner that is most effective to a particular golfer and which can be changed for different golfers.

It is another object of the present invention to provide a golf putting practice device that fully controls movement of the golf club in a plurality of planes.

It is another object of the present invention to provide a golf putting practice device that fully controls all phases of a golf putting stroke.

SUMMARY OF THE INVENTION

These, and other, objects are achieved by a practice device for putting which comprises a base unit which is placed on the ground, a frame unit fixed to the base unit, a golf club clamp unit slidably mounted on the frame unit to move in a first linear direction and rotatably mounted on the frame to move in a first rotational direction, a golf club clamping element rotatably mounted on the golf club clamp unit and rotating in a second rotational direction, a groove defined in the golf club clamping element, a clamping unit on the golf club clamping element, and a golf club slidably held in the groove to move in a second linear direction and a third rotational direction.

The clamp unit attaches a golf club to the cross bar of the frame unit so the club is controlled while it is moved in a swinging motion. The clamp unit can be attached to the golf club at any desired location on the shaft of the club so the device can be customized for the particular golfer.

Using the device of the present invention, movement of the club is controlled both in the swinging direction and in an up and down direction as well as in a plurality of rotational directions so full control of the club is exerted by the device. All phases of the putting swing are thus controlled by the device of the present invention.

It is noted that while a putting stroke is discussed, other strokes can be used with this device as will occur to those skilled in the art based on the teaching of this disclosure.

DETAILED DESCRIPTION OF THE INVENTION

Figure 1A:
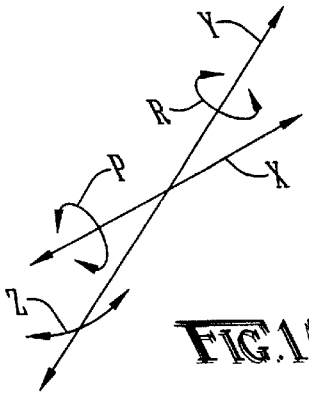
FIG. 1A is a diagram illustrating the multiplanar control associated with the device of the present invention.
Figure 1:
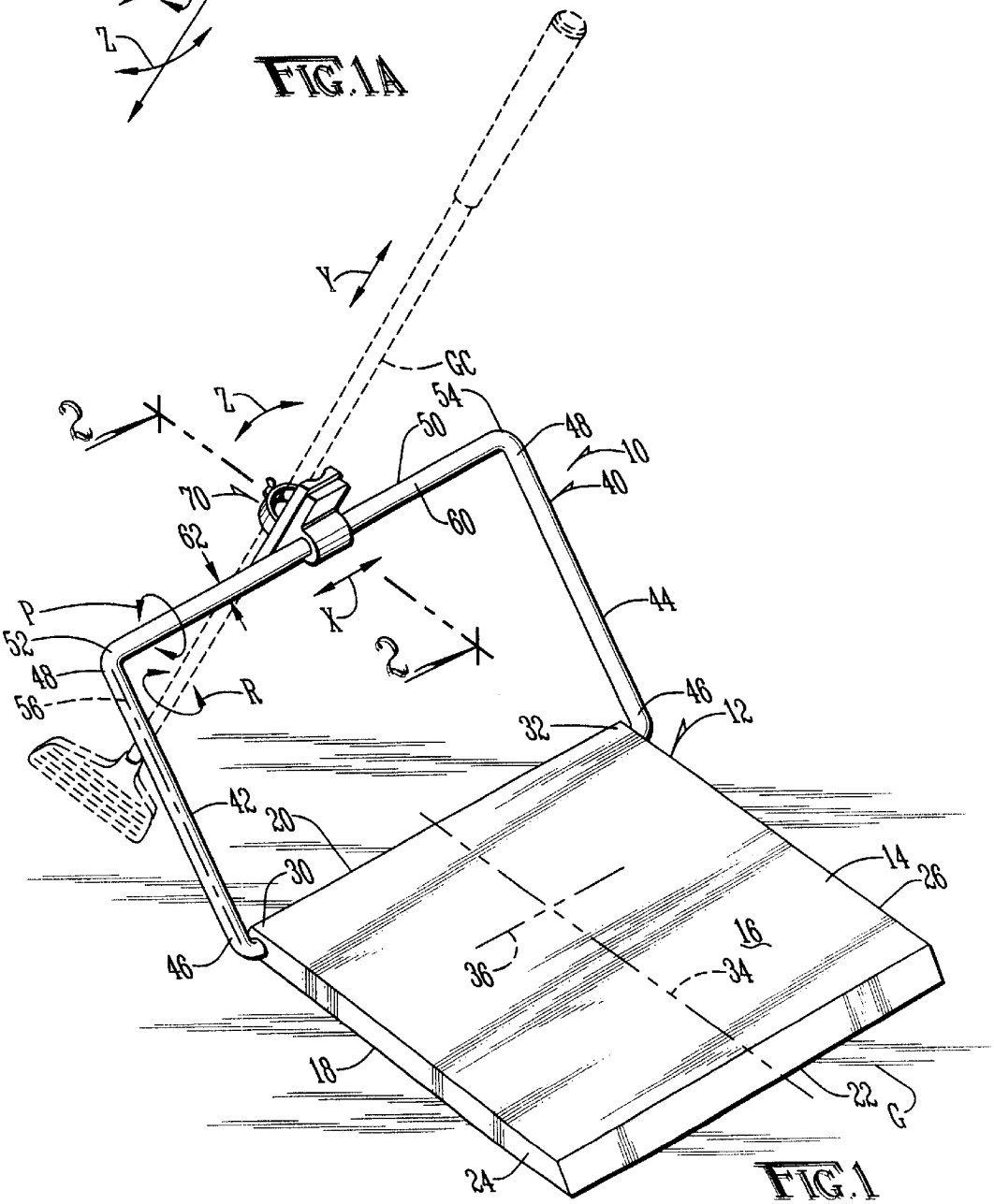
FIG. 1 is a perspective view of the practice device for putting embodying the present invention.
Figure 2:
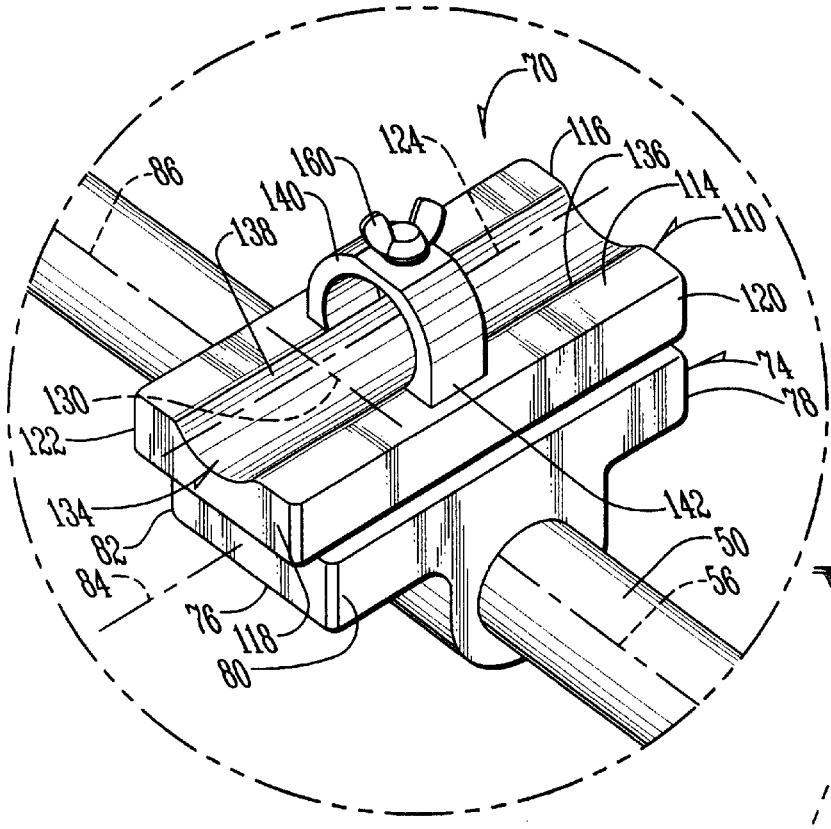
FIG. 2 is a view taken along line 2—2 of FIG. 1.
Figure 3:
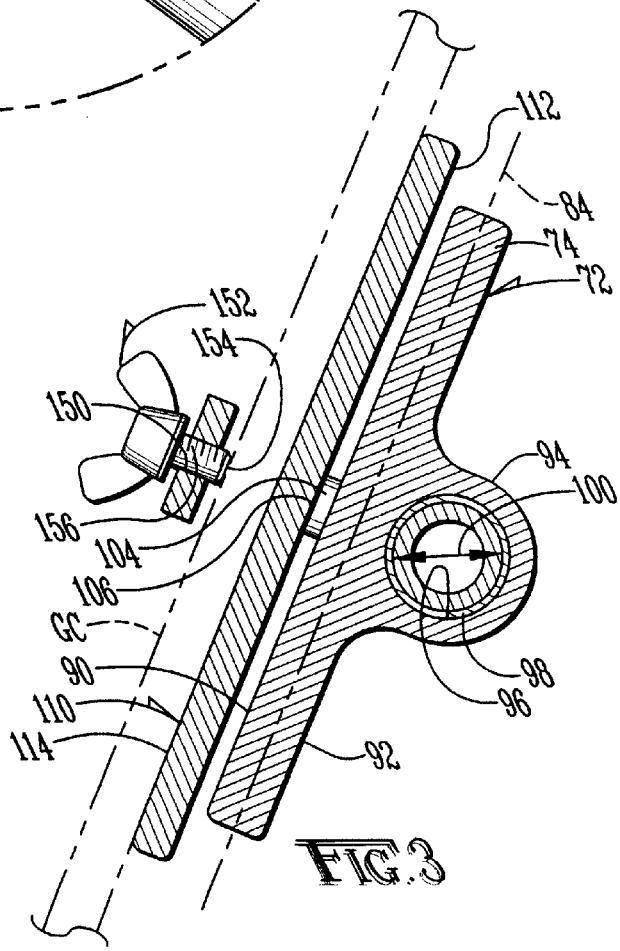
FIG. 3 is a detail view of detail 3 in FIG. 1.

Other objects, features and advantages of the invention will become apparent from a consideration of the following detailed description and the accompanying drawings.

Referring to the figures, it can be seen that the present invention is embodied in a practice device 10 for teaching and practicing a golf putting stroke. Device 10 comprises a base unit 12 which includes a support base 14 having a top surface 16, a bottom surface 18 which rests on ground G when in use, a front edge 20, a rear edge 22, first and second side edges 24 and 26 respectively that extend from front edge 20 to rear edge 22 of support base 14 and intersect front and rear edges 20 and 22 of support base 14. Two front corners 30 and 32 are formed by the intersection of first and second side edges 24 and 26 of base unit 12 and front edge 20 of the base unit. A longitudinal axis 34 extends between front edge 20 and rear edge 22 of support base 14 and a transverse axis 36 extends between first and second side edges 24 and 26 of support base 14.

Device 10 further includes a frame element 40 fixed to support base 14. Frame element 40 includes first and second side bars 42 and 44 each having a proximal end 46 fixed to a side edge of support base 14 adjacent to first and second corners 30 and 32 respectively and a distal end 48 spaced from the proximal end 46. The side bars 42 and 44 extend upwardly from support base 14 at an oblique angle with respect to ground G when support base 14 is resting on the ground. Frame element 40 further includes a cross bar 50 which has two ends 52 and 54 each of which is attached to a distal end 48 of the first and second side bars 42 and 44 of the frame element 40. Cross bar 50 includes a longitudinal axis 56 extending between ends 52 and 54 of the cross bar and in the direction of transverse axis 36 of support base 14, an outside surface 60, and an outer dimension 62. The purpose of the frame element 40 will be understood from the teaching of the following discussion.

Device 10 further includes a clamp unit 70 which includes a cross bar-engaging unit 72 having a base 74 which includes first and second side edges 76 and 78, a first end edge 80, a second end edge 82, a longitudinal axis 84 extending between first and second side edges 76 and 78 of base 74 of cross bar-engaging unit 72 of clamp unit 70 and extending transversely to the longitudinal axis 56 of cross bar 50 when clamp unit 70 is mounted on cross bar 50 of frame element 40 of the base unit. Base 74 of cross bar-engaging unit 72 has a transverse axis 86 which extends between first and second end edges 80 and 82 of base 74 of cross bar-engaging unit 72 of clamp unit 70. Base 74 further includes a top surface 90, a bottom surface 92 and a cross bar-engaging element 94 on bottom surface 92 of the bar-engaging unit 72. Cross bar-engaging element 94 extends along transverse axis 86 of cross bar-engaging unit 72 of clamp unit 70 and along longitudinal axis 56 of cross bar 50 when clamp unit 70 is mounted on the cross bar 50 of the frame element 40 of base unit 12. Cross bar-engaging element 94 has a bore 96 defined therethrough, and an elongate tubular insert 98 located in bore 96 defined through cross bar-engaging element 94 of bar engaging unit 72. Tubular insert 98 has an inner dimension 100 that is larger than outer dimension 62 of cross bar 50 and slidably receives the cross bar 50 therethrough.

A fastener 104 has a proximal end which is rotatably mounted on base 74 of the bar-engaging unit 72 and has a distal end 106 that is spaced from top surface 90 of base 74 when fastener 104 is mounted on base 74 of the bar-engaging unit 72.

Device 10 further includes a golf club clamping element 110 having a bottom surface 112 which is located adjacent to top surface 90 of base 74 when the golf club clamping element 110 is attached to clamp unit 70. Distal end 106 of fastener 104 is rotatably engaged with bottom surface 112 of the golf club clamping element 110 to rotatably mount the golf club clamping element 110 on the base 74 of the bar engaging unit 72.

Clamping element 110 further includes a top surface 114, first and second side edges 116 and 118, a first end edge 120, a second end edge 122, a longitudinal axis 124 extending between first and second end edges 116 and 118 of the golf club clamping element 110 and along longitudinal axis 84 of base 74 of clamp unit 70 and transverse to longitudinal axis 56 of cross bar 50. Clamping element 110 further includes a transverse axis 130 extending between first and second side edges 120 and 122 of the golf club clamping element 110. An elongate groove 134 is defined in top surface 114 of the golf club clamping element 110 and extends along longitudinal axis 124 of the golf club clamping element 110 from first side edge 116 to second side edge 118 of the golf club clamping element 110 and extends transverse to longitudinal axis 56 of cross bar 50. Elongate groove 134 has sides 136 and 138. A clamping strap 140 has ends 142 mounted on the golf club clamping element 110 adjacent to sides 136 and 138 of elongate groove 134.

A threaded fastener-receiving bore 150 is defined through clamping strap 140 adjacent to elongate groove 134 and a threaded fastener 152 is threadably received in threaded bore 150 through the clamping strap 140. Threaded fastener 152 has a distal end 154 located between clamping strap 140 and elongate groove 134 and a proximal end 156 located adjacent to clamping strap 140 with the clamping strap 140 located between proximal end 156 of threaded fastener 152 and the elongate groove 134. A wing nut 160 is on proximal end 156 of threaded fastener 152.

One form of device 10 includes a metal tubular insert element 98 with the bar engaging unit 72 and the golf club clamping element 110 being plastic. In one form of the device, support base 14 is grass colored to create an environment conducive to practice.

A golf club GC is accommodated in groove 134 by sliding the golf club under clamping strap 140. Once the golf club is in place, threaded fastener 152 is tightened down to slidably clamp the golf club in place on cross bar 50. The golf club is held in place in groove 134, but can slide along longitudinal axis 84 so the club can move as required to match a natural putting motion during use of device 10. Clamp unit 70 then slides along the cross bar 50 and also rotates with respect to the cross bar 50 to control the swinging motion of the golf club.

The rotatable mounting of the golf club clamping element 110 on base 74 of the bar engaging unit 72 permits the golf club GC to rotate with respect to cross bar 50 during practice of the golf swing. This encourages natural motion of the swing so the swing is not constrained by device 10. This rotation is coupled with the sliding movement of golf club GC in groove 134 to further encourage natural movement during the practice swings. Thus, device 10 controls a swing and also permits movement in a plurality of planes. This multi-planar movement control effects controlled natural swings when using device 10.

The controlled multiplanar movement of a golf club effected by device 10 is indicated by the diagram in FIG. 1A. Golf club controlled movement is effected in two linear directions: directions along an x-axis X that corresponds to directions along longitudinal axis 56 of cross bar 50, and directions along a y-axis Y that correspond to directions along longitudinal axis 84, as well as in a yaw direction Z that results from the rotational connection of cross bar engaging unit 72 to golf club clamping element 110 and is rotational about fastener 104 in a plane containing golf club clamping element 110, in a pitch direction P that is rotational around cross bar 50 as well as in a roll direction R about shaft S of the golf club that results from the sliding connection of the golf club to the groove 134.

As can be appreciated from the teaching of this disclosure, motion along the cross bar 50 as well as motion transverse to the cross bar 50 and rotation of the golf club during the swinging movement is controlled by device 10. Thus, the full motion of the golf club is controlled. Furthermore, the device can be clamped to the golf club at any location on the golf club so the device can be set according to the exact desires of the user and will thus be more effective than a device that is pre-set. By adjusting the amount of clamping force exerted on the golf club by threaded fastener 152, the amount of movement of the golf club transverse to cross bar 50 as well as any roll motion of the golf club can be controlled as well. Thus, if a golfer wishes to exert more control over either or both of those phases of the swing, he can do so. This provides considerable latitude in controlling what phase of a golf swing is emphasized and thus practiced using device 10. For example, if a golfer is having trouble pulling away from a putt, he or she can tighten clamping strap 140 to prevent the putter from moving transversely with respect to cross bar 50 during use of device 10. On the other hand, if such pulling away or towards the plane of the putt is not a problem, the golfer can keep clamping strap 140 loose so the golf club can freely move transversely with respect to cross bar 50 during the swing practice. Any degree of clamping between these two end points as well as the amount of roll permitted is also possible.

By curving the cross bar, other golf swings can be practiced as well.

It is understood that while certain forms of the present invention have been illustrated and described herein, it is not to be limited to the specific forms or arrangements of parts described and shown.

I claim:

1. A practice device for putting comprising:

a) a base unit which includes (1) a support base having (A) a top surface, (B) a bottom surface which rests on the ground when in use, (C) a front edge, (D) a rear edge, (E) first and second side edges that extend from the front edge to the rear edge of the support base and intersect the front and rear edges of the support base, (F) two front corners formed by the intersection of the first and second side edges of the base unit and the front edge of the base unit, (G) a longitudinal axis extending between the front edge and the rear edge of the support base, and (H) a transverse axis extending between the first and second side edges of the support base, and (2) a frame element fixed to said support base and including (A) first and second side bars each (i) having a proximal end fixed to a side edge of the support base adjacent to the first and second corners respectively, (ii) having a distal end spaced from the proximal end, and (iii) extending upwardly from the support base at an oblique angle with respect to the ground when the support base is resting on the ground, (B) a cross bar (i) having two ends each of which is attached to a distal end of the first and second side bars of the frame element, (ii) a longitudinal axis extending between the two ends of the cross bar and in the direction of the transverse axis of the support base, (iii) an outside surface, and (iv) an outer dimension; and b) a clamp unit which includes (1) a cross bar-engaging unit having (A) a base which includes (i) first and second side edges, (ii) a first end edge, (iii) a second end edge, (iv) a longitudinal axis extending between the first and second side edges of the base of the cross bar-engaging unit of said clamp unit and extending transversely to the longitudinal axis of the cross bar when said clamp unit is mounted on the cross bar of the frame element of said base unit, (v) a transverse axis extending between the first and second end edges of the base of the cross bar-engaging unit of said clamp unit, (vi) a top surface, (vii) a bottom surface, and (viii) a cross bar-engaging element on the bottom surface of the bar-engaging unit of said clamp unit, the cross bar-engaging element extending along the transverse axis of the bar-engaging unit of said clamp unit and along the longitudinal axis of the cross bar when the clamp unit is mounted on the cross bar of the frame element of said base unit, the cross bar-engaging element having a bore defined therethrough, (B) an elongate tubular insert in the bore defined through the cross bar-engaging element of the bar engaging unit, the tubular insert having an inner dimension that is larger than the outer dimension of the cross bar and slidably receives the cross bar therethrough, (C) a fastener having a proximal end which is rotatably mounted on the base of the bar-engaging unit and a distal end that is spaced from the top surface of the base of the bar-engaging unit when the fastener is rotatably mounted on the base of the bar-engaging unit, and (2) a golf club clamping element having (A) a bottom surface which is located adjacent to the top surface of the base of said clamp unit when the golf club clamping element is attached to said clamp unit, (B) the distal end of the fastener of said clamp unit being rotatably engaged with the bottom surface of the golf club clamping element to rotatably mount the golf club clamping element on the base of the bar engaging unit of said clamp unit, (C) a top surface, (D) first and second side edges, (E) a first end edge, (F) a second end edge, (G) a longitudinal axis extending between the first and second end edges of the golf club clamping element and along the longitudinal axis of the base of said clamp unit and transverse to the longitudinal axis of the cross bar, (H) a transverse axis extending between the first and second side edges of the golf club clamping element, (I) an elongate groove defined in the top surface of the golf club clamping element and extending along the longitudinal axis of the golf club clamping element from the first side edge to the second side edge of the golf club clamping element and extending transverse to the longitudinal axis of the cross bar, the elongate groove having sides, (J) a clamping strap having ends mounted on the golf club clamping element adjacent to the sides of the elongate groove, (K) a threaded fastener-receiving bore defined through the clamping strap adjacent to the elongate groove, and (L) a threaded fastener threadably received in the threaded bore through the clamping strap, and having (i) a distal end located between the clamping strap and the elongate groove, (ii) a proximal end located adjacent to the clamping strap with the clamping strap located between the proximal end of the threaded fastener and the elongate groove, and (iii) a wing nut on the proximal end of the threaded fastener.

2. The practice device as described in claim 1 wherein the tubular insert element is constructed of metal.

3. The practice device as described in claim 2 wherein the bar engaging unit and the golf club clamping element are constructed of plastic.

4. The practice device as described in claim 1 further including a golf club slidably and rotatably mounted in the elongate groove defined in the top surface of the golf club clamping element.

* * * * *